US005284524A

United States Patent [19]

DeCoux

[11] Patent Number: 5,284,524

[45] Date of Patent: Feb. 8, 1994

[54] METHOD AND APPARATUS FOR ENHANCING SURFACE TREATMENT OF PERFORATED MATERIALS

[75] Inventor: Steven P. DeCoux, Long Beach, Calif.

[73] Assignee: Rockwell International Corporation, Seal Beach, Calif.

[21] Appl. No.: 770,253

[22] Filed: Oct. 3, 1991

[51] Int. Cl.[5] ..... B08B 3/04

[52] U.S. Cl. ..... 134/22.18; 134/34; 134/42

[58] Field of Search ..... 134/22.18, 34, 37, 42

[56] References Cited

U.S. PATENT DOCUMENTS

| | | | |
|---|---|---|---|
| 2,883,310 | 4/1959 | McAuley et al. | 134/34 |
| 3,360,400 | 12/1967 | Evans et al. | 134/34 |
| 3,868,272 | 2/1975 | Tardoskegyi | 134/26 |
| 4,607,947 | 8/1986 | Ensing et al. | 134/1 |
| 5,039,349 | 8/1991 | Schoeppel | 134/26 |
| 5,092,355 | 3/1992 | Cadwell et al. | 134/34 |
| 5,122,195 | 6/1992 | Hoffman | 134/42 |

*Primary Examiner*—Anthony McFarlane

*Attorney, Agent, or Firm*—Terrell P. Lewis; Charles T. Silberberg

[57] ABSTRACT

A method and apparatus for irrigating perforations in the surface of a perforated material during surface treatment operations. The apparatus includes a three-layer substrate of predetermined length including a first fluid-interactive layer, a second resilient layer, and a third rigidifying layer. In the method, the substrate is placed beneath the perforated surface to be treated with the perforated material overlying the first layer. Thereafter, the surface treatment tool is used to apply and remove pressure to and from the surface during performance of the surface treatment operation. In this way, as the surface is treated, fluid applied to the surface during the operation is caused to pass back and forth to and from the first layer and through the perforations to irrigate the perforations and thereby keep them from becoming clogged. In addition, the pressure applied to the surface by the tool causes fluid held by the first layer beneath the perforated surface to be expelled through the perforations in a region about the tool-surface interface, thereby flushing those perforations peripheral to the tool-surface interface.

15 Claims, 1 Drawing Sheet

METHOD AND APPARATUS FOR ENHANCING SURFACE TREATMENT OF PERFORATED MATERIALS

BACKGROUND OF THE INVENTION

1. Field of the Invention

The present invention relates to processes of abrading, cleaning or polishing perforated materials, and more particularly to a method and apparatus for irrigating perforations in surfaces of such materials during such treatments thereby preventing clogging of the perforations during the surface treatment operations.

2. Background of the Invention

Perforated materials, and especially micro-perforated materials, have recently gained much notoriety in the aerospace technology for their ability to ensure conformance of the flow of air or other fluid to or over a surface. In particular, these materials have proven very useful in providing laminar flow control of fluids over aerodynamic surfaces.

Often, during manufacture of perforated materials, the major surfaces of the materials need to be treated to obtain a polished, blemish-free finish. And following extended use, the surfaces need to be re-finished to remove deposits or various imperfections that could affect the laminar flow characteristics of the perforated surface which has been immersed in the fluid.

At present, all known methods of abrading, polishing or cleaning perforated surfaces are inadequate insofar as remnants of abrading, polishing or cleaning compounds remain within the perforations following surface treatment. These surfaces must thereafter be further treated, as for example by blowing pressurized air through the perforations to expel the remnants trapped in the holes. As a result of such added steps, these known methods not only prolong the time before the surfaces are useful, but also require the use of unnecessary equipment, thus increasing the cost of performing the entire abrading, polishing or cleaning operation.

OBJECTS AND SUMMARY OF THE INVENTION

It is therefore an object of the present invention to provide a novel method and apparatus for enabling rapid and efficient surface treatments of perforated materials which will overcome all the deficiencies and drawbacks of currently known systems of like kind for surface treatments of these materials.

Another object of the present invention is to provide a novel method for irrigating perforations of such materials during performance of the surface treatments.

Still another object of the invention is to provide a novel apparatus for assisting in the process of cleaning or polishing a perforated surface while assuring unobstructed perforations upon the termination of the cleaning or polishing process.

These and other objects are achieved by providing a method and apparatus for fluid irrigation of the surface perforations during surface treatments. The apparatus includes a three-layer sheet of predetermined length including a first fluid-interactive layer, a second resilient layer, and a third rigidifying layer.

The method contemplates disposing the three-layer sheet beneath the perforated surface to be treated with the first layer disposed directly behind the perforated surface, and thereafter using the surface treatment tool to apply and remove pressure to and from the surface during performance of the surface treatment operation. In this way, as the surface is treated, fluid applied to the surface during the operation is caused to pass back and forth to and from the first layer and through the perforations to irrigate the perforations and thereby keep them from becoming clogged. In addition, the pressure applied to the surface by the tool causes fluid held by the first layer beneath the perforated surface to be expelled through the perforations in a region about the tool-surface interface, thereby flushing those perforations peripheral to the tool-surface interface.

DETAILED DESCRIPTION OF THE INVENTION

Figure 1:
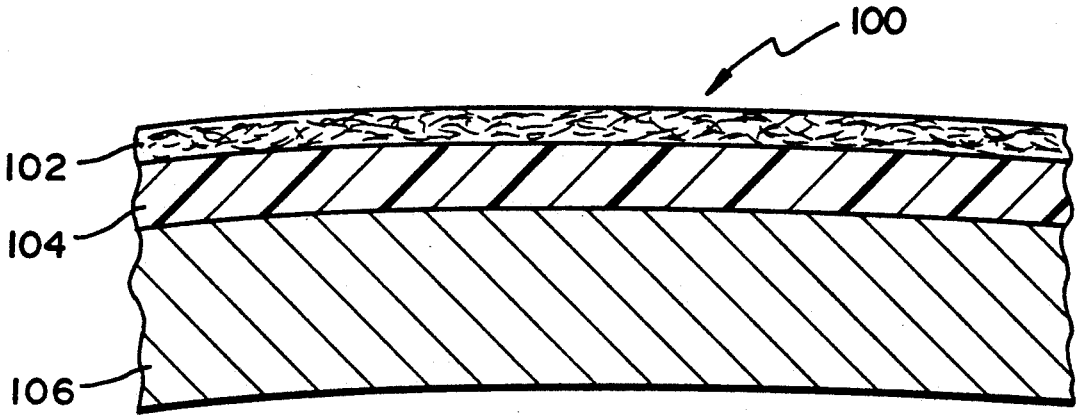
FIG. 1 is a sectional view of a portion of the support system of the present invention showing the various layers thereof.

Referring now to FIG. 1, the apparatus 100 of the present invention is shown to include a first layer 102, a second layer 104 and a third layer 106. The first layer 102 is made of an absorbent fluid-interactive material (such as a thick cotton material, or a synthetic breather blanket), and is capable of retaining the fluid. The second layer 104 is disposed immediately beneath the first layer and made of a resilient closed cell material such as flexible polyurethane or ethafoam. The second layer is adapted to initiate interaction of the first layer with the cooling or lubricating fluid being used in the surface treatment process taking place. The third layer 106 is made of a substantially rigid material (eg., plywood or stainless steel) capable of rigidifying the two layers which are positioned atop the third layer. The second and third layers are bonded together, as for example using epoxy or other adhesive bonding techniques. In addition, while the first layer is secured relative to the second layer, the invention contemplates the replacement of the first layer to permit disposal of undesirable particles which typically collect in the first layer 102 over a period of time.

Figure 2:
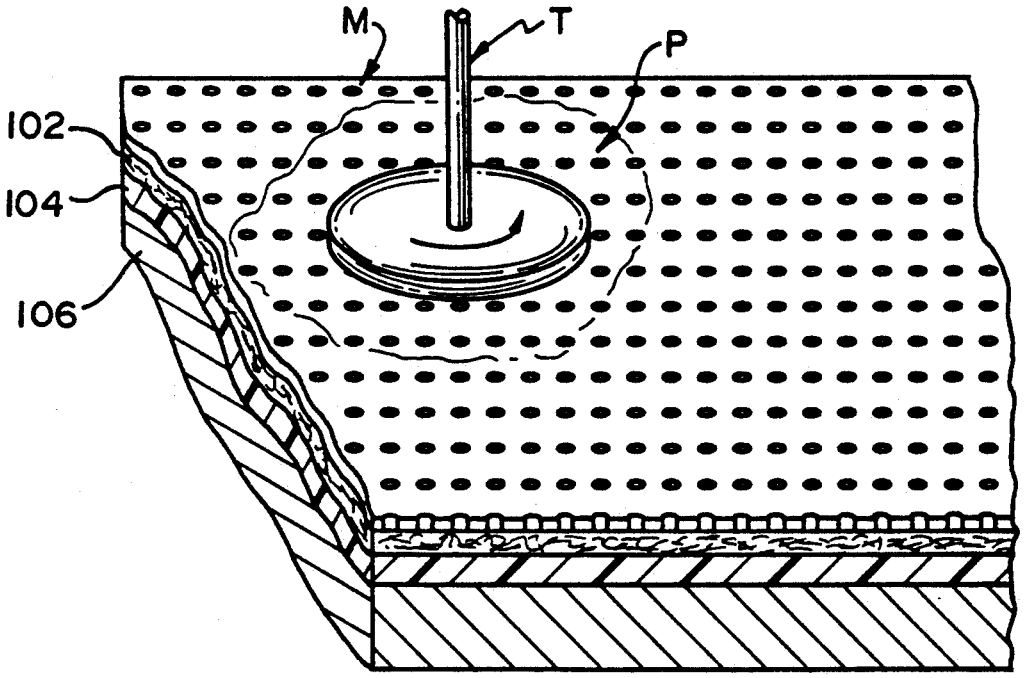
FIG. 2 shows the support system of the present invention disposed beneath a perforated workpiece during application of a surface treatment tool.

As shown in FIG. 2, the method of the invention contemplates disposing the apparatus immediately adjacent and behind the perforated material M on which the surface treatment is to be performed. In this manner of placement of the apparatus relative to the perforated material, the first layer 102 is located adjacent and interfaces with a surface of the perforated material which is not to be surface-treated. The second layer, which comprises a material adapted to activate interaction of the first layer the with cooling or lubricating fluid being used with the surface-treating process taking place, is located immediately behind the first layer. The third layer, which is a material having a high degree of rigidity, is adapted to rigidify the entire stack of layers.

During surface treatment of the perforated material, the cooling or lubricating fluid (eg., water) used with the surface-treating tool T is of a type typically sprayed or otherwise liberally applied on the surface during the process. The method of the present invention contemplates that the three layers of the inventive apparatus will work together to cause the fluid to repeatedly pass back and forth through the perforations, thereby repeatedly irrigating and ultimately preventing clogging of the perforations during the process.

The apparatus of the present invention is particularly useful where micro-perforated materials are being surface-treated. Micro-perforations are known to be perforations having diameters less than about 0.005". Generally, these types of perforations are incapable of being drilled by mechanical drill bits, and laser equipment or electron beam apparatus must be used to form them.

In the case of such micro-perforations, as the tool T interacts with the perforated material surface, chips of material (if the process is abrading or polishing) or debris (if the process is cleaning) mix with the fluid to form a slurry. The slurry is absorbed by the material of the first layer. Thus, the slurry seeks the level of the interface between the first and second layers and washes out to collection areas at the edges of the perforated material. The second layer is non-absorbent, and assists, in response to the pressure applied by the surface-treating tool, in driving the unadulterated fluid in the first layer back through the perforations to the tool-surface interface as well as the peripheral region P about the tool-surface interface. As the tool moves about the treatable surface of the perforated material, so does the region P, and thus a continuous cleansing of the perforations of the material takes place.

Thus it is apparent that there has been provided, in accordance with the present invention, an apparatus and method for irrigating perforations in a perforated surface undergoing surface treatment which is simple in construction and function, requires very little cost to manufacture, and yet fully satisfies the objectives, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations which fall within the spirit and scope of the appended claims.

What I claim is:

1. A method of preventing clogging of perforations in a perforated workpiece during a treatment of one surface thereof, said method comprising:

supporting a perforated region of said workpiece atop a laminated backing member.

said member having a first layer adapted for absorptive and expulsive interaction with a fluid used during said treatment and a second layer for initiating alternative expulsion and absorption of said fluid from said first layer in response to corresponding applications and withdrawals of pressure to said first layer during the carrying out of said treatment, and applying pressure to said perforated region to expel fluid from said first layer through said perforations and withdrawing pressure to cause said fluid to pass through said perforations into said first layer.

2. The method of claim 1, wherein said step of supporting a perforated region of said workpiece atop a laminated backing includes providing rigid means for rigidifying said first and second layers.

3. The method of claim 2, wherein said rigid means comprises a third layer of said laminated backing.

4. The method of claim 1 wherein said surface treatment comprises an abrading treatment, and said fluid used during said treatment comprises a lubricating fluid.

5. The method of claim 1, wherein said surface treatment comprises a cleaning treatment, and said fluid used during said treatment comprises water.

6. The method of claim 1, wherein said second layer comprises a resilient, closed cell material.

7. The method of claim 1, wherein the perforations in said perforated workpiece comprise micro-perforations, and said repetitive application and withdrawal of pressure to and from said one layer during said treatment is accomplished via a tool used to perform said treatment.

8. A method for irrigating a perforated panel including first and second opposing surfaces, said method comprising:

providing a layered support panel including a fluid-interactive layer and a resilient layer, positioning the fluid-interactive layer of the support panel immediately behind the first surface of the perforated panel, so that said perforated panel is supported on said support panel, applying fluid to a region of the perforated panel second surface, and performing surface treatment on said perforated second surface while, at the same time applying pressure to said second surface to expel fluid from said fluid interactive layer through said perforations, and then removing pressure from said second surface to cause said fluid to pass through said perforations into said fluid interactive layer such that said perforations are irrigated during said surface treatment.

9. The method of claim 6, wherein said step of providing said layered support panel further comprises providing a rigid member positioned behind said fluid-retentive and said resilient layers.

10. The method of claim 9, wherein said step of performing surface treatment on said second surface comprises cleaning said second surface.

11. The method of claim 10, wherein said step of performing surface treatment on said second surface includes the step of abrading said second surface.

12. The method of claim 9, wherein said step of performing surface treatment on said second surface comprises abrading said second surface.

13. The method of claim 8, wherein the openings in said perforated panel comprise micro-perforations, and the steps of applying and removing pressure to and from said second surface is accomplished via a tool used to perform said treatment.

14. The method of claim 8, wherein said steps of applying and removing pressure to and from said second surface of said perforated panel are performed at least two times.

15. A method of flushing debris from perforations in a perforated panel while performing surface treatments on said perforated panel, comprising:

supporting a region of said perforated panel where said surface treatments are performed atop a support member including a fluid-retentive layer and a resilient layer, applying a fluid to said region of said perforated panel, applying a tool to said region to treat said perforated surface while, at the same time applying and releasing pressure via the tool at said region, said perforated panel, at said region, interacting with said resilient layer of said support member, in response to the application and release of pressure, to successively apply force to and remove force from said fluid-retentive layer thereby sequentially driving the fluid back and forth through the perforations in the perforated panel.

* * * * *